United States Patent [19]

Kang

[11] Patent Number: 4,898,052

[45] **Date of Patent: * Feb. 6, 1990**

[54] AUTOMATICALLY CONTROLLED SOCKET WRENCH

[76] Inventor: Byung K. Kang, 1516-5 Jung 2-Dong, Pusan Eunghang Apt. #101, Haeundae-Ku, Pusan, Rep. of Korea

[ * ] Notice: The portion of the term of this patent subsequent to Mar. 21, 2006 has been disclaimed.

[21] Appl. No.: 212,692

[22] Filed: Jun. 28, 1988

[30] Foreign Application Priority Data

Jan. 8, 1988 [KR] Rep. of Korea ..... 12988[U]

[51] Int. Cl.[4] ..... B25B 13/00

[52] U.S. Cl. ..... 81/57.43; 81/63; 81/163

[58] Field of Search ..... 81/57.13, 63, 163, 165, 81/60, 61, 62

[56] References Cited

U.S. PATENT DOCUMENTS 2,292,391 8/1942 Merriman et al. ..... 81/57.43
3,901,107 8/1975 Halls ..... 81/165
4,112,792 9/1978 Guimarin ..... 81/63
4,277,991 7/1981 Stubenruch ..... 81/163
4,813,309 3/1989 Kang ..... 81/57.43

*Primary Examiner*—Frederick R. Schmidt
*Assistant Examiner*—Maurina Rachuba
*Attorney, Agent, or Firm*—Birch, Stewart, Kolasch & Birch

[57] ABSTRACT

An automatically controlled socket wrench which comprises a body having handle, a rotating gear member including a pair of jaws which containing a screwing aperture disposed in a supporter extended therefrom and a worm gear member, a controlling wire rope connected to the worm gear member and a button, a stopper for stopping the rotating gear, and a cover for covering the rotating gear assembled with the controlling wire rope and stopper therein whereby when the button is operated, the jaws are caused to open, and after the socket wrench is manipulated around an object, by returning the button and suspending the stopper, the jaws of the socket wrench are automatically and strongly closed around the object.

6 Claims, 3 Drawing Sheets

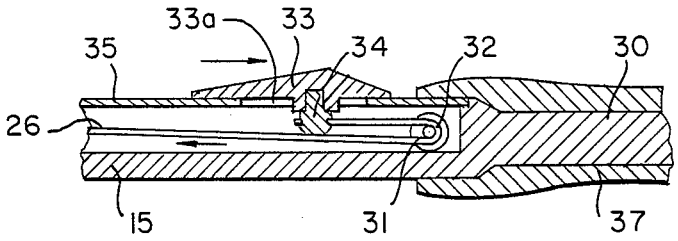
FIG. 5
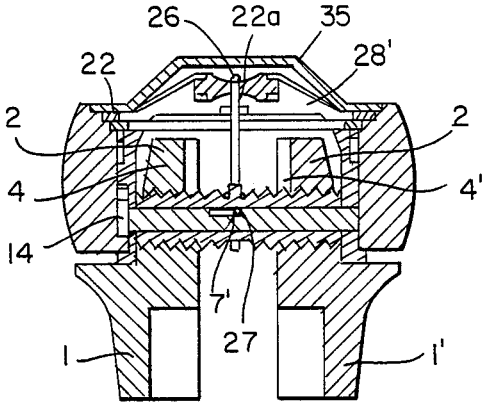
FIG. 6
FIG. 7
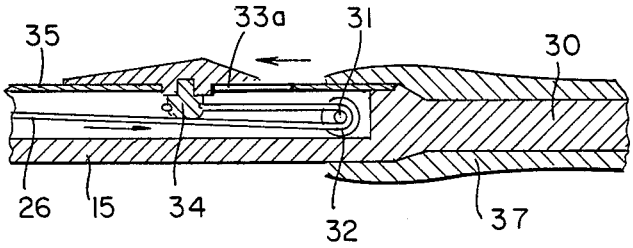

AUTOMATICALLY CONTROLLED SOCKET WRENCH

BACKGROUND OF THE INVENTION

1. Field of the Invention

The present invention relates to an automatically controlled socket wrench and more particularly, to a socket wrench having jaws which can be tightly closed around and released from an object by operating a button. The wrench is used for any size object with little effort being required by the user.

2. Description of the Prior Art

There are many types of socket wrenches which are well known in the art which utilize a ratchet handle and various size sockets engageable with the ratchet handle. However, these wrenches suffer from a number of difficulties such as, for example, the difficulty in selecting a socket which properly mates with the object to which it is applied. Also the sockets can be easily lost and are expensive to manufacture. Furthermore, in specific wrenches, such as monkey spanners, the thumb must be utilized to push a lever against the bias of a worm gear to permit the jaws of the monkey spanners to close around the desired object.

The present applicant has also received patent application Ser. No. 87-5352, filed Nov. 25, 1987, U.S. Pat. No. 4,313,309 issued on Mar. 21, 1989 which discloses an automatically controlled socket wrench wherein, a controlled wire rope is wound along a hole formed at a plate spring which is wound along a worm gear shaft.

SUMMARY OF THE INVENTION

Accordingly, it is an object of the present invention to provide an automatically controlled socket wrench having an operating button disposed thereon.

Another object of the present invention is to provide a socket wrench which is easy to operate and possesses a strong grasping power.

A further object of the present invention is to provide a socket wrench which can be utilized on any size object without the use of a variety of socket sizes.

Still another object of the present invention is to provide a socket wrench which can be readily locked to an object by a lever.

Yet another object of the present invention is to provide a socket wrench which includes a plate spring for preventing a wire rope from twisting so that the socket wrench can be used for a long period of time.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to an automatically controlled socket wrench which comprises a body having handle, a rotating gear member including a pair of jaws which contain a plurality of screwing apertures, a worm gear operatively engaged in the screwing apertures, a plate spring connected to a shaft of the worm gear, a controlling wire rope connected to the worm gear and a button disposed on the handle, a stopper for stopping the rotating gear, and a cover for covering the rotating gear assembled with the controlling wire rope and the stopper, whereby, when the button moves forward, the jaws are caused to open, and after the socket wrench is manipulated around an object, by returning the button and suspending the stopper, the jaws of the socket wrench are automatically and securely closed around the object.

BRIEF DESCRIPTION OF THE DRAWINGS

The present invention will become more fully understood from the detailed description give hereinbelow and the accompanying drawings which are given by way of illustration only, and thus are not limitative of the present invention, and wherein:

FIG. 5 is a sectional view of a button portion of the socket wrench of the present invention with the button in a position it operates;

FIG. 6 is a side sectional view of the head portion of the socket wrench of the present invention showing the worm gear in an open position; and FIG. 7 is a sectional view of a button portion of the socket wrench of the present invention with the button in a position after it operates.

DETAILED DESCRIPTION OF THE INVENTION

Figure 1:
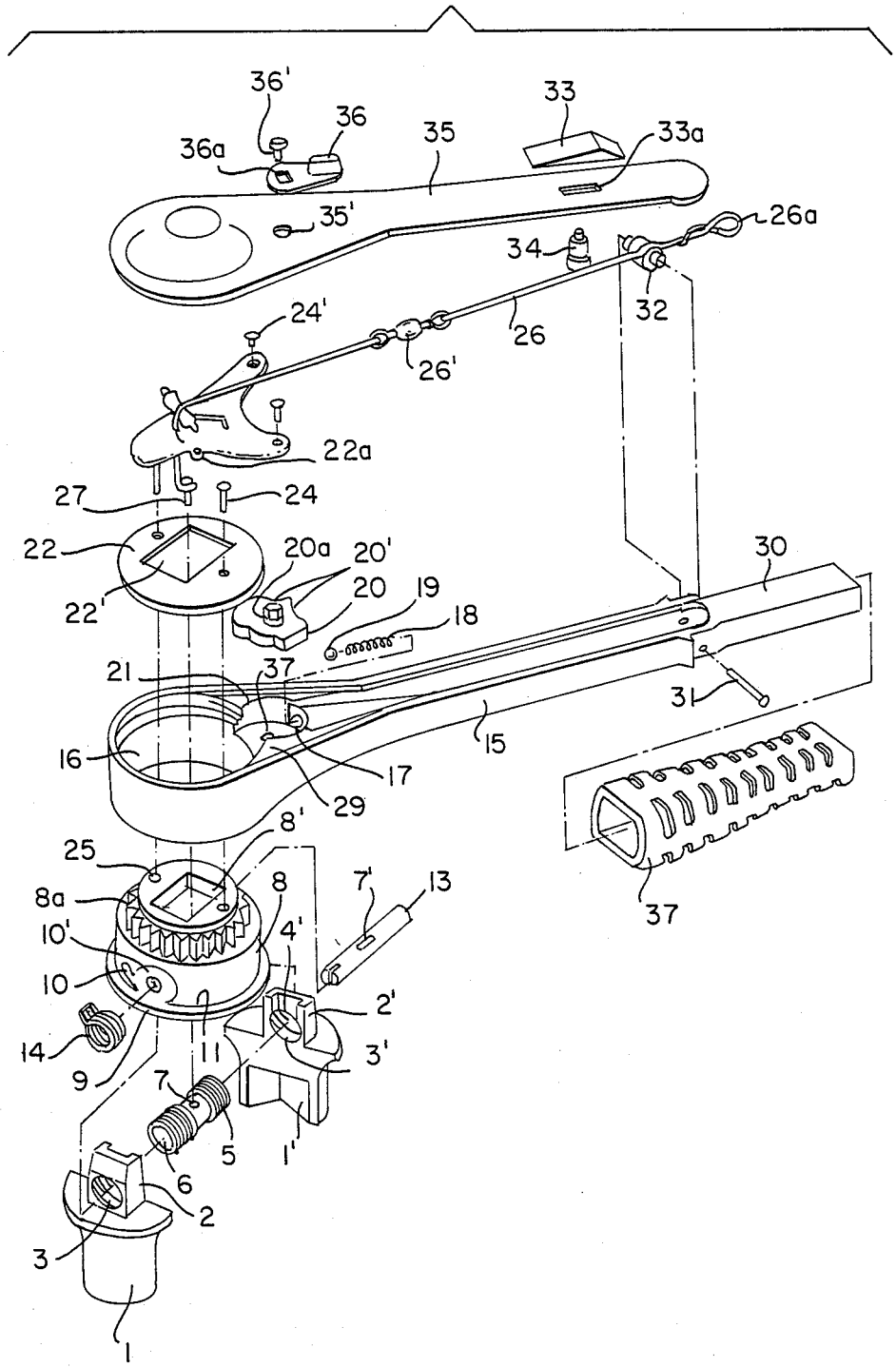
FIG. 1 is an exploded perspective view showing the basic components of the automatically controlled socket wrench of the present invention.
Figure 2:
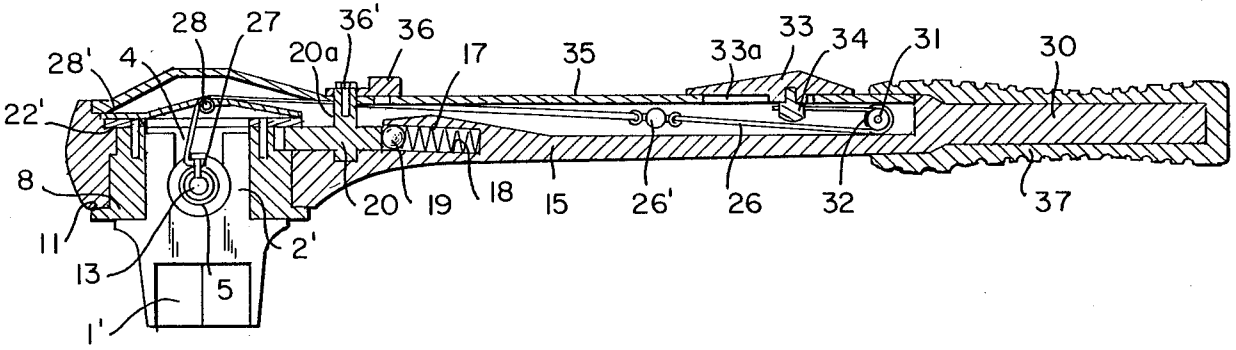
FIG. 2 is a cross-sectional view of the automatically controlled wrench of the present invention.

Referring now in detail to the drawings for the purpose of illustrating preferred embodiments of the present invention, the automatically controlled socket wrench as shown in FIGS. 1 and 2 comprises a body member 15, a stopper 20, a rotating gear member 8, a double worm gear member 5, a pair of movable jaws 1, a controlling wire rope 26, a cover member 35 and a handle 37.

The body member 15 having apertures 29 is provided with a rotating gear engaging member 16, a plate engaging member 23 and a stopper engaging member 21 for engaging the rotating gear member 8, the cover member 35, and the stopper 20, respectively.

The rotating gear member 8 contains rotating gear teeth 8*a*, spring engaging aperture 10, having a spring fixing portion 10, a raised portion 11, a guiding slot 8', and pin apertures 25 disposed therein. A plate spring 14 engages the spring engaging aperture 10', and one end of the plate spring 14 engages the spring fixing portion 10 of the rotating gear member 8. The movable jaws 1 are provided with a grasping member 1', for tightly grasping an object which can have any configuration. The jaws 1 extend from a supporter 2 which includes a screwing aperture 3 and a slot 4 in the supporter 2.

A double worm gear member 5 having a tubular shaft 6 and a pin aperture 7 therein is operatively engaged in the screwing aperture 3. An axial pin 7', is mounted in the tubular shaft 6. The axial pin 7', is provided with an opening 12 at one end thereof for fixing the other end of the plate spring by a bolt 9. The double worm gear member 5 contains worm gears 5', which are disposed in opposite directions for selectively opening or closing the pair of movable jaws 1.

Figure 3:
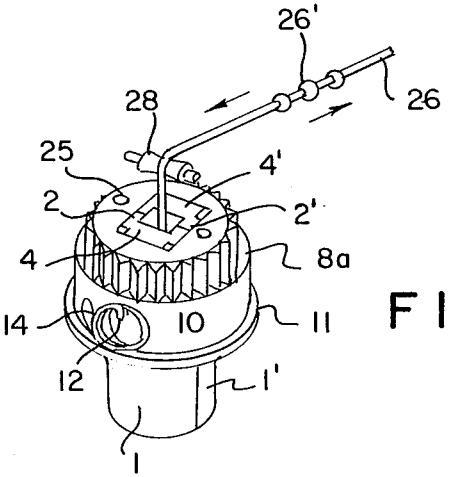
FIG. 3 is a perspective view of a head portion of the socket wrench of the present invention showing a plate spring associated a rotating gear member.

A circular plate 22 having a rectangular aperture 22', disposed at the center thereof engages the plate engaging member 23 by means of bolts 24. The controlling wire rope 26 disposed within the body member 15 is connected to the double worm gear member 5 at one end by a bolt 27 and at the other end by a ring 26a disposed at the other end thereof. The controlling wire rope 26 includes an adjusting member 26' for controlling the length thereof. A roller 28 operatively wound by the controlling wire rope 26 is supported by a roller support member 28, which includes a hole 22a for passing the controlling wire rope 26 therethrough (FIG. 3).

The cover member 35 having a small aperture 35' and a large aperture 33a for moving a movable bolt 34 which is attached to the button 33. The ring 26a extended to the controlling wire rope 26 engages with the movable nut 34 through a small roller 32 having bolt 31. The stopper 20 is provided with a rectangular pin 20a for corresponding a rectangular hole 36a of a lever 36. The lever 36 is assembled to the stopper 20 by engaging an aperture 17 disposed in the body member 15 together with the cover member 35 through a bolt 36'. Slots 20' receive a ball 19 disposed at one end of a resilient spring 18. The other end of the resilient spring 18 engages one corner of the stopper engaging member 21. The resilient spring 18 is biased against the stopper 20 (FIG. 2). The handle 37 is provided with a rough portion 30 disposed therearound for permitting the tight grasping of the handle 37.

In assembly, after the double worm gear member 5 is secured into the screwing apertures 3, the pair of movable jaws 1 are secured into the rotating gear member 8 by inserting the axial pin 13 of the double worm gear member 5 secured to the jaws 2 into the spring engaging aperture 10' of the rotating gear member together with the plate spring 14. At this time, the plate spring 14 is secured into the spring engaging aperture 10' by fixing one of its ends into the spring fixing portion 10 and inserting the other end into the opening 12 of the axial pin 13 by means of the bolt 9. Thereafter, the assembly containing the rotating gear member 8, double worm gear member 5, pair of movable jaws 1 and the stopper 20 with the resilient spring 18 is inserted into the body 15, and the circular plate 22, and roller support member 28' are attached to the body 12 by securing the bolt 27 into the pin aperture 7' disposed in the axial pin 13. Thereafter, the cover member 35 is inserted into the body member 15 by securing the bolt 31 into the movable nut 34 and securing the bolt 36' into the aperture 37 disposed in the stopper engaging member 21 of the body member 15 through the tubular aperture 38 disposed in the rectangular pin 20a of the stopper 20 and the aperture 35' disposed in the cover 19 as shown in FIG. 2. The handle 37 is engaged by the rough portion 30 of the body member 15.

Figure 4:
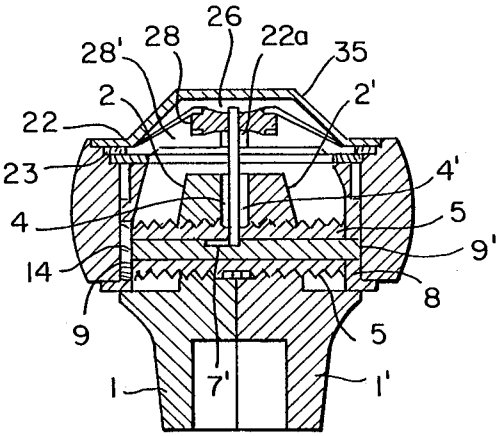
FIG. 4 is a side sectional view of the head portion of the socket wrench of the present invention showing a worm gear in a closed position.

FIGS. 4 and 5 show a sectional view of the head portion and button portion of the assembly containing all of the components of the socket wrench of the present invention wherein the jaws 2 are in a closed position. When the button 33 does not operate, that is, is not moved forward, the controlling wire rope 26 does not pull against the bias rotating the double worm gear member 5.

As shown in FIGS. 6 and 7, when the button 33 is pushed to move forward, the double worm gear member 5 rotates in the clockwise direction and causes the worm gears 5' of the coaxial double worm gear member 5 to rotate. The double worm gears 5' of the double worm gear member 5 engage with the plurality of screws disposed on the screwing apertures 3 of the supporters 2 of the movable jaws 1, whereby the jaws 1 are opened. As shown in FIG. 3, the jaws 1 of the socket wrench of the present invention can be easily manipulated around any size object. Also, by operating the button 33, the jaws 1 of the socket wrench are automatically and strongly closed around the object, no matter what its size. At this time, by operating the lever 36 which the user decides to conveniently work, the resilient spring 18 is suspended to one side direction. By working the wrench, the object is rotated to be tightened or loosened only toward the suspended direction.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An automatically controlled socket wrench which comprising:

a body member containing a handle, a rotating, hollow gear member disposed within said body member, said rotating, hollow gear member containing a spring plate engaging aperture disposed thereon, a pair of opposing jaw members slidably mounted within said rotating hollow gear member, said pair of opposing jaw members containing a supporter having a screwing aperture, respectively, a double worm gear member with gears for engaging with said screwing apertures, said double worm gear member having a tubular shaft for receiving an axial pin, a stopper member disposed in said body member, said stopper member being adapted to operatively engage said rotating gear member for restricting its rotation with said body member by operating a lever, and a controlling wire rope connected to said double worm gear member at one end thereof and to switching means at the other end thereof through rollers, said rollers being disposed above the double worm gear member and disposed in said handle, whereby, upon the operation of the means for switching, the jaws are caused to open against the bias of the plate spring, and after the jaws are positioned around an object and after the operation of the lever and the suspending of the stopper member, the jaws are automatically and strongly closed by the spring plate around said object.

2. The socket wrench of claim 1 wherein the double worm gear member contains oppositely directed gears for engagement with the screwing apertures.

3. The socket wrench of claim 1 wherein the controlling wire rope member is disposed in an aperture disposed at the center of a roller support member.

4. The socket wrench of claim 1 wherein the double worm gear member is rotatably mounted to the rotating gear member by the axial pin.

5. The socket wrench of claim 1 wherein the opposing jaws are provided with grasping members disposed therein for tightly closing around an object.

6. The socket wrench of claim 1 wherein a cover member is provided for covering the rotating gear member.

* * * * *